United States Patent [19]

Fujimura

[11] Patent Number: 4,581,822

[45] Date of Patent: Apr. 15, 1986

[54] ELECTRIC HAIR CLIPPER

[75] Inventor: Einosuke Fujimura, Fukuoka, Japan

[73] Assignee: Kyushu Hitachi Maxell, Ltd., Fukuoka, Japan

[21] Appl. No.: 681,482

[22] Filed: Dec. 13, 1984

[30] Foreign Application Priority Data

Dec. 15, 1983 [JP] Japan ..... 58-193864[U]
Mar. 19, 1984 [JP] Japan ..... 59-52944

[51] Int. Cl.[4] ..... B26B 19/06; B26B 19/20

[52] U.S. Cl. ..... 30/216; 30/201; 30/220

[58] Field of Search ..... 30/210, 216, 218, 219, 30/220, 201

[56] References Cited

U.S. PATENT DOCUMENTS

| | | | |
|---|---|---|---|
| 511,966 | 1/1894 | Olsen | 30/216 X |
| 1,997,096 | 4/1935 | Andis . | |
| 2,067,075 | 1/1937 | Clark | 30/201 |
| 2,222,317 | 11/1940 | Martin | 30/43 |
| 2,265,383 | 12/1941 | Martin | 30/43 |
| 2,731,720 | 1/1956 | Henard | 30/201 |
| 3,046,654 | 7/1962 | Letchfield | 30/201 |
| 3,648,370 | 3/1972 | Cercone | 30/201 |
| 3,992,778 | 11/1976 | Urbush | 30/216 |
| 4,249,307 | 2/1981 | Andis | 30/216 |

FOREIGN PATENT DOCUMENTS 1099084 8/1955 France .

*Primary Examiner*—Jimmy C. Peters
*Attorney, Agent, or Firm*—Birch, Stewart, Kolasch & Birch

[57] ABSTRACT

The disclosure is directed to an improved electric hair clipper of a type with a pivotal head portion, having a comb plate for comb-cutting, in which a blade unit is arranged to be slidable for releasable attachment with respect to the head portion, in a longitudinal direction intersecting at right angles with a pivoting direction of the head portion through an engaging and sliding arrangement including sliding projections and corresponding guide grooves in which the sliding projections are fitted for sliding movement, so that no excessive loads are applied to a pivotal axis or pivotal angle restricting portion of the head portion, while the blade unit can be readily detached without having to touch the blade edge with a finger.

10 Claims, 30 Drawing Figures

ELECTRIC HAIR CLIPPER

BACKGROUND OF THE INVENTION

The present invention generally relates to a hair cutting instrument and more particularly, to an improved electric hair clipper which is arranged to releasably mount a blade unit having a stationary blade and a movable blade in an efficient manner, with respect to a head portion pivotally connected to a grip portion of a main body casing.

As shown by FIG. 2 illustrating the general appearance of an electric hair clipper according to one preferred embodiment of the present invention, the hair clipper includes a main body casing 1 having a grip portion 1*a* and a head portion 1*b* provided with a stationary blade 63 and a movable blade 64 adapted to slidably move on the stationary blade 63, and the head portion 1*b* is pivotally connected to the grip portion 1*a* at a support axis 3 for pivotal movement between a fundamental position where it is held generally on a straight line with respect to the grip portion 1*a* and an inclined position where it is turned upwardly at an angle with respect to the grip portion 1*a*.

When the head portion 1*b* having the stationary blade 63 and the movable blade 64 is arranged to be pivotable with respect to the grip portion 1*a* as described above, it is possible to provide versatility in the cutting operation by adopting different modes of applications suitable for various cuttings, as compared with general hair clippers in which a head portion at a blade edge side is integrally formed on a straight line with respect to a grip portion of a main body casing, with a stationary blade being held at a predetermined angle with respect to the head portion of the main body casing, although not particularly shown.

More specifically, in the arrangement having the head portion 1*b* adapted to be pivotable with respect to the grip portion 1*a* as shown in FIG. 2, the hair clipper is convenient for use in trimming-up, downy hair cutting, cutting at a top portion of a head, etc. at the fundamental position where the head portion 1*b* is held on a straight line with respect to the grip portion 1*a*, when the hair clipper is used at another position where the head portion 1*b* is inclined upwardly with respect to the grip portion 1*a*, it is efficiently applied to the uniform cutting around ears, trimming, combining-cut, forelock cutting, etc.

Incidentally, in the hair clipper as described above with reference to FIG. 2, it is necessary to facilitate maintenance of the stationary blade 63 and the movable blade 64, and also removal of cut hair therefrom, and for this purpose, such blades 63 and 64 have been accommodated in a blade unit 33, which is detachably mounted onto the head portion 1*b*. In the above case, it is required to provide means for releasably mounting the blade unit 33 onto the head portion 1*b* in an efficient manner.

As shown of a conventional hair clipper in FIG. 1 having the pivotable head portion of the above type with respect to the grip portion G of the main body casing C, if the arrangement is so made, for example, that a blade unit B is pivotally and detachably connected, at its rear side edge Bb, with a head portion H through a hinge T, while a forward edge Ba of the blade unit B is releasably engaged with the head portion H through a lock means L, removal of the blade unit B from the head portion H is to be effected in such a manner that the blade unit B is released from locking via the locking means L by strongly depressing the blade unit B downward, with a finger being applied to the blade edge S of the blade unit B projecting forward from the head portion H, so as to be subsequently turned downwardly and rearwardly about the hinge portion T, and thereafter, is disengaged from the head portion H at the hinge portion T. However, when the blade unit B is strongly depressed downward for disengagement as described above, the forward edge of the head portion H is also to be depressed hard downwardly, thus resulting in such disadvantages that excessive loads or torsion are applied to the pivotal axis, and pivotal angle restricting portion, etc. of the head portion H, thereby tending to cause disengagement or damages at these portions. Moreover, adhesion of cut hair and oil at the blade edge, to the finger tips gives an unpleasant feeling to a user, and since the finger tips contact the blade edge, there may be some people who feel unsafe, thus presenting a problem from the viewpoint of actual use.

SUMMARY OF THE INVENTION

Accordingly, an essential object of the present invention is to provide an improved electric hair clipper of a type with a pivotal head portion having a comb plate for comb-cutting, in which a blade unit is arranged to be slidable for releasable attachment with respect to the head portion, in a longitudinal direction intersecting at right angles with a pivoting direction of the head portion through an engaging and sliding means including sliding projections and corresponding guide grooves in which the sliding projections are fitted for sliding movement therein, whereby no excessive loads are applied to a pivotal axis or pivotal angle restricting portion of the head portion, while the blade unit can be readily detached without having to touch the blade edge with a finger.

Another important object of the present invention is to provide an electric hair clipper of the above described type in which the engaging and sliding means for the blade unit with respect to the head portion is positionally set on approximately the same line as a line in the longitudinal direction passing through a center of the pivotal axis for the head portion, thereby to prevent unexpected pivotal movements of the head portion during mounting of the blade unit for positive and facilitated attachment of the blade unit.

A further object of the present invention is to provide an electric hair clipper of the above described type which is simple in construction, functions stably, has high reliability, and can be readily manufactured at low cost.

In accomplishing these and other object according to one preferred embodiment of the present invention, there is provided an electric hair clipper which includes a main body casing having a grip portion provided therein with a motor and a power switch and a head portion pivotally connected to the grip portion at a support axis for pivotal movement about the support axis with respect to the grip portion, a blade unit including a stationary blade, a movable blade adapted to slidably contact the stationary blade under pressure and a follower piece fixed to the movable blade.

The blade unit is slidably and releasably mounted on the head portion in a position beyond the support axis in a longitudinal direction intersecting at right angles with the upward and downward direction for the pivotal movement of the head portion through an engaging and sliding means including sliding projections and corresponding guide grooves in which the sliding projections are fitted for sliding movement therein and respectively provided in the blade unit and head portion. This engaging and sliding means is positionally set approximately on the same line as a line in the longitudinal direction passing through a center of the support axis. Meanwhile, the head portion is provided with a vibrating piece for converting rotation of the motor into reciprocating movement, with a vibrating lever formed at one end of the vibrating piece being arranged to project toward a blade unit mounting portion at a forward side of the head portion for engagement with the follower piece upon mounting of the blade unit onto the head portion. The vibrating piece is adapted to effect the pivotal movement together with the head portion, with a shaft of the motor being associated with the follower piece by the vibrating piece. There is also provided a comb plate slidably accommodated in the head portion for advancing or retreatment with respect to the edge of the stationary blade between a position corresponding to the edge and another position not corresponding to the edge. The head portion is arranged to pivotally move between a first position where its axis is held generally on a straight line with respect to an axis of the grip portion and a second position where its axis is inclined toward the comb plate to form a predetermined angle with respect to the axis of the grip portion, with only the blade edge being exposed out of the head portion and located above an extension line of the upper wall of the grip portion.

By the arrangement according to the present invention as described above, an improved electric hair clipper has been advantageously presented.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
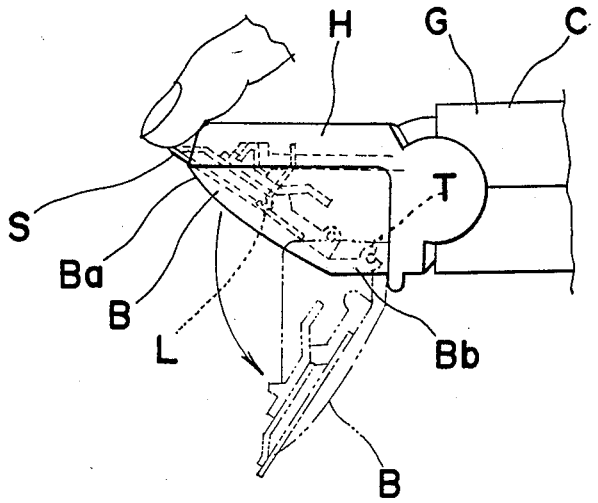
Fig. 1 PRIOR ART
FIG. 1 is a fragmentary side elevational view of a conventional electric hair clipper.

Before the description of the present invention proceeds, it is to be noted that like parts are designated by like reference numerals throughout the accompanying drawings.

Figure 2:
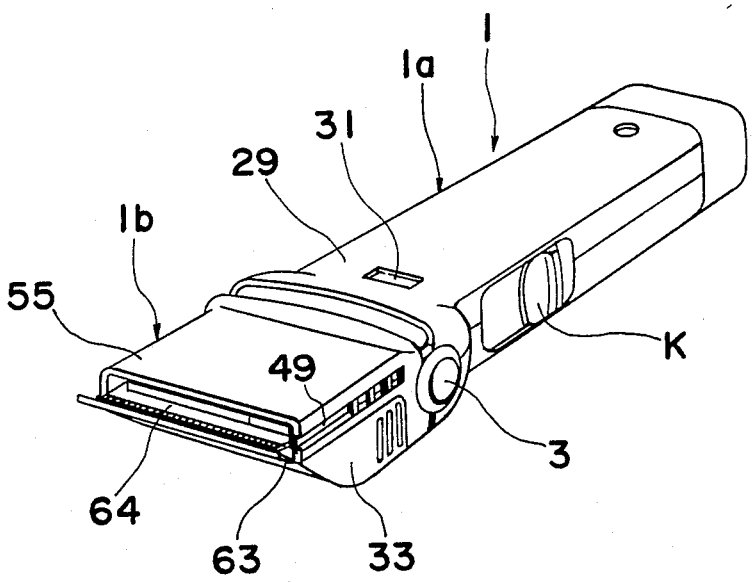
FIG. 2 is a perspective view showing an electric hair clipper according to one preferred embodiment of the present invention.
Figure 3:
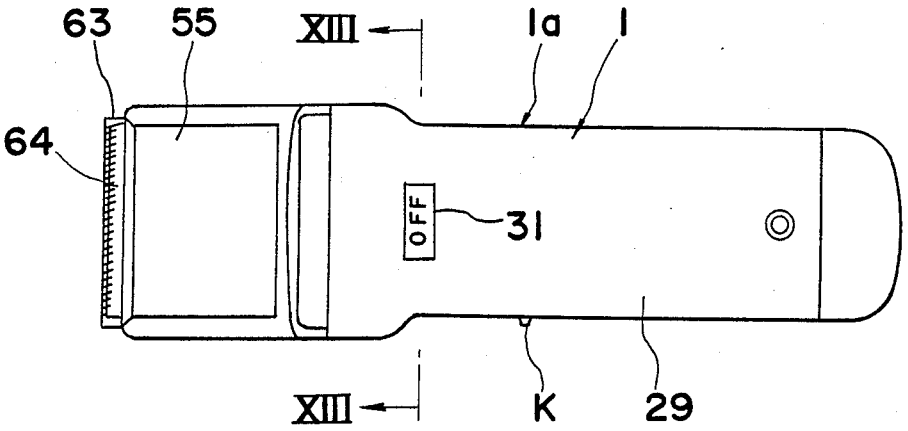
FIG. 3 is a top plan view of the electric hair clipper of FIG. 2.
Figure 4:
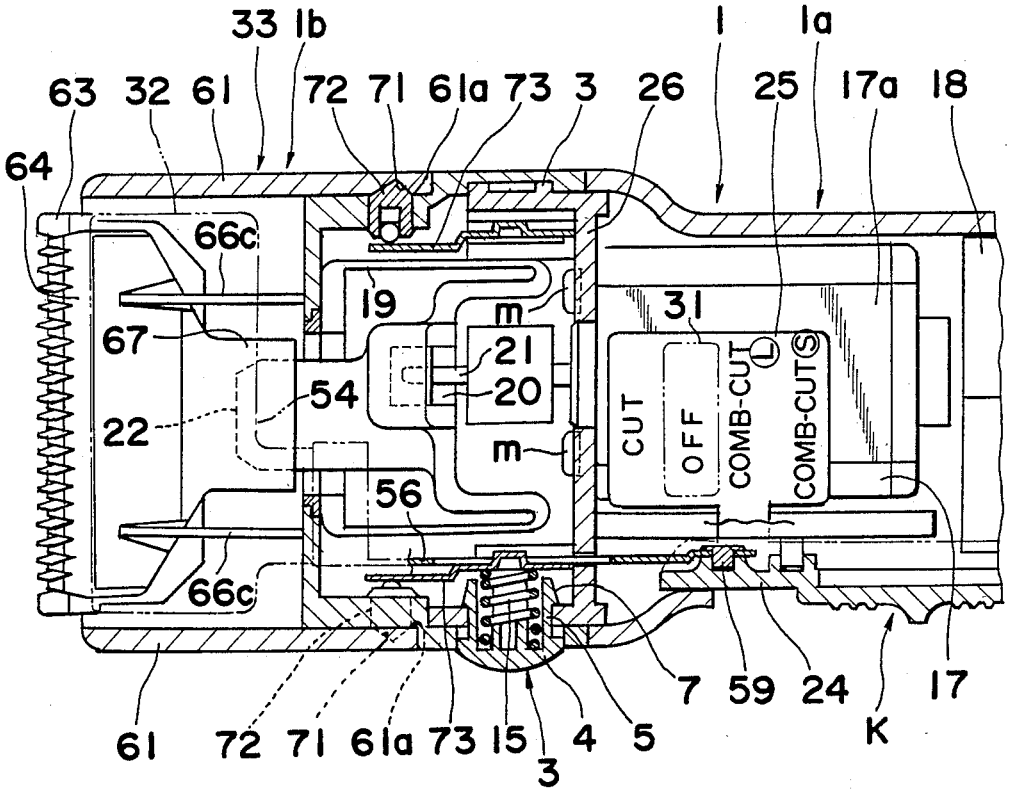
FIG. 4 is a fragmentary top plan sectional view showing, on an enlarged scale, a main portion of the electric hair clipper of FIG. 2.

Referring now to the drawings, particularly to FIGS. 2 through 4, there is shown an electric hair clipper according to one preferred embodiment of the present invention includes the main body casing 1 having the grip portion 1*a* longitudinally extending in a long rectangular box-like configuration and the head portion 1*b* pivotally connected, at the pivotal axis, i.e., opposed support shafts 3, with the front portion of the grip portion 1*a*. More specifically, the head portion 1*b* is arranged to be pivotable between the fundamental position where its axis is held generally on a straight line with respect to the axis of the grip portion 1*a* as shown in solid lines in FIG. 18 and the upwardly inclined position where its axis is inclined at a predetermined angle with respect to the axis of the grip portion as shown by the imaginary lines in FIG. 18.

Head Portion Pivotal Movement Lock Means

Referring particularly to FIGS. 8 through 12, one shaft 3' of the opposed support shafts is integrally formed with the grip portion 1*a*, while the other shaft 3 of the support shafts also serves as a pivotal movement lock button for the head portion 1*b* so that the head portion 1*b* can be positioned at the fundamental position where it is held generally on the straight line with respect to the grip portion 1*a*, and at the upwardly inclined position where it is turned by a predetermined angle with respect to the grip portion through change-over respectively.

Figure 8:
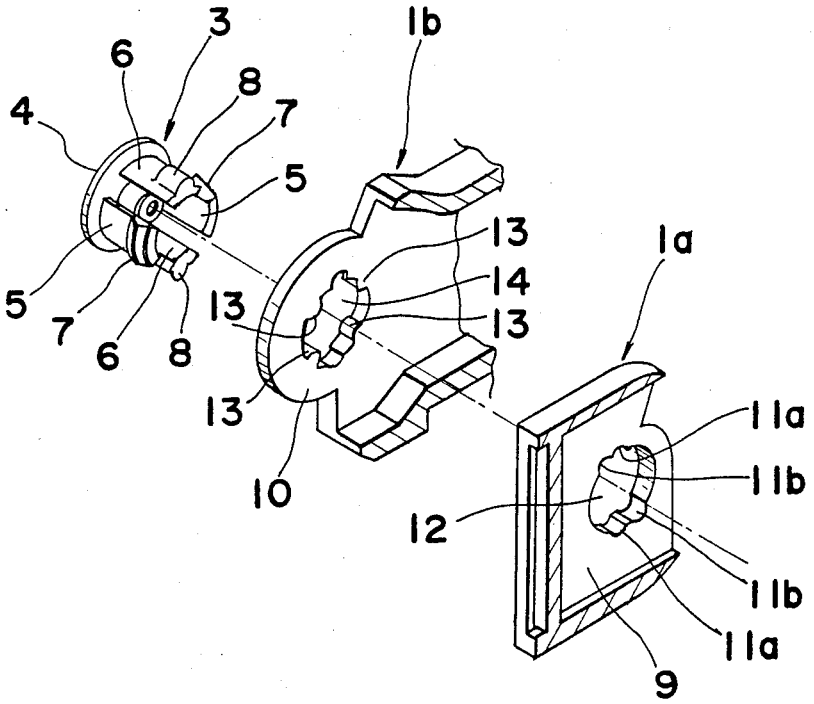
FIG. 8 is an exploded perspective view showing on an enlarged scale, a pivotal movement lock portion for the head portion.
Figure 11:
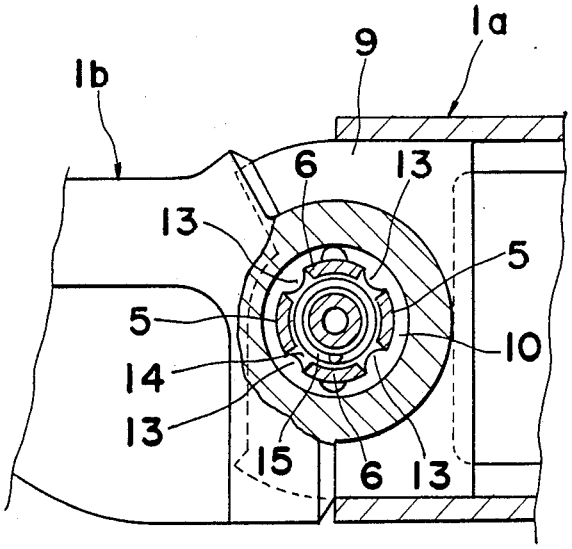

More specifically, as shown in FIG. 8, the other support shaft 3 also used for the locking as referred to above, is molded, for example, by a plastic material in the form of a split-rivet, and includes a head 4, and a pair of opposed resilient legs 5 and another pair of opposed resilient legs 6, with the legs 5 being formed with retaining claws 7 at their forward ends, while the legs 6 are also formed with ribs 8 at the outer faces on the forward ends thereof. In a side wall 9 at the forward end of the grip portion 1*a* and a corresponding side wall 10 of the head portion 1*b* overlapping the outer surface of the side wall 9, there are respectively formed a shaft hole 12 having four recesses 11*a* and 11*b* in its inner peripheral edge and another shaft hole 14 having four protrusions 13 in its inner peripheral edge, so as to be communicated with each other, and the support shaft 3 is inserted into the shaft holes 12 and 14. In this case, as shown in FIG. 11, the support shaft 3 is prevented from rotation, with the four legs 5 and 6 thereof being fitted between the protrusions 13 of the shaft hole 14 at the side of the head portion 1*b*. More specifically, as shown in FIG. 12, with respect to the shaft hole 12 at the side of the grip portion 1*a*, the four legs 5 and 6 of the support shaft 3 are rotatably inserted, and the retaining claws 7 of the legs 5 are engaged with the inner side peripheral edge of the shaft hole 12 for retaining in the axial direction, while the ribs 8 of the legs 6 are selectively engaged with the recesses 11*a* or 11*b* of the shaft hole 12.

Moreover, the support shaft 3 which, is inserted into the shaft holes 12 and 14, so as to be displaceable in the axial direction, is normally urged outwardly in the axial direction by a built-in spring 15 disposed between the support shaft 3 and a plate spring 73 (FIG. 4) to be described later, with the ribs 8 of the legs 6 being engaged with the recesses 11*a* or 11*b*.

Figure 9:
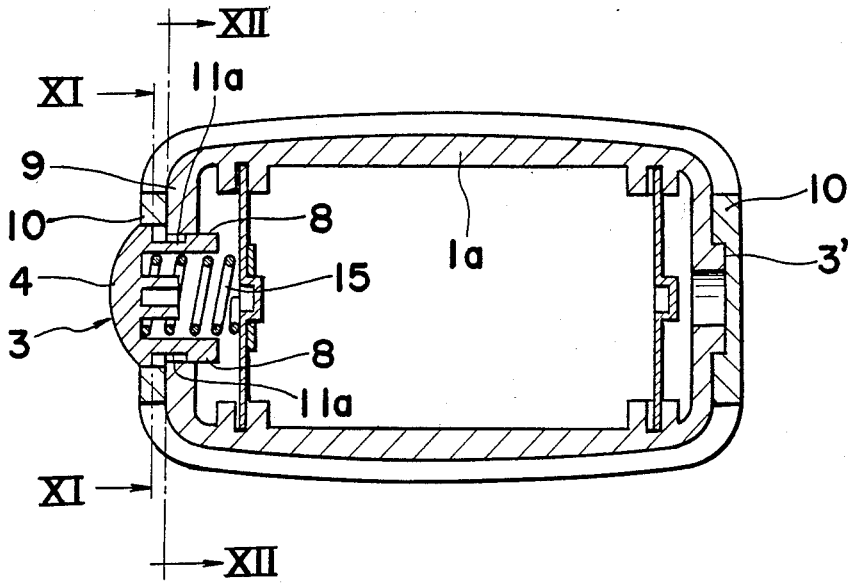
FIG. 9 is a cross section of the electric hair clipper of FIG. 5, with the pivotal movement lock portion being in a locked state.
Figure 12:
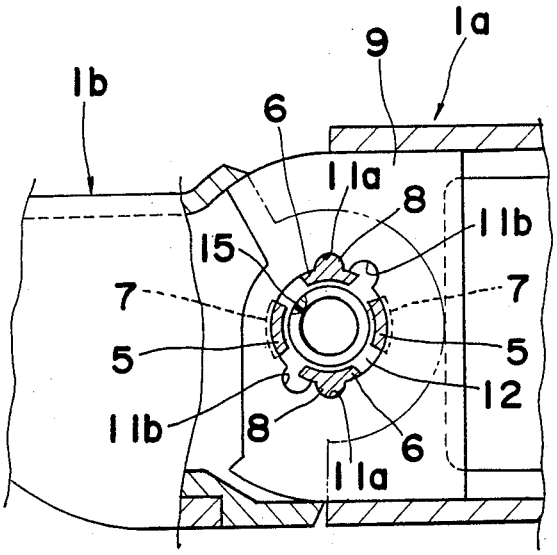
FIG. 12 is a cross section taken along the line XII—XII in FIG. 9.
Figure 13:
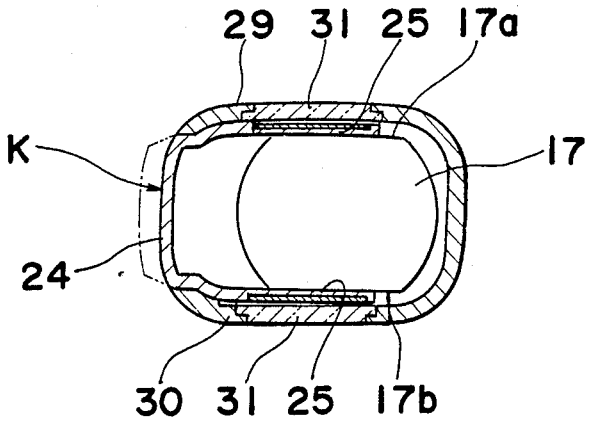
FIG. 13 is a cross section taken along the line XIII—XIII in FIG. 3.
Figure 14:
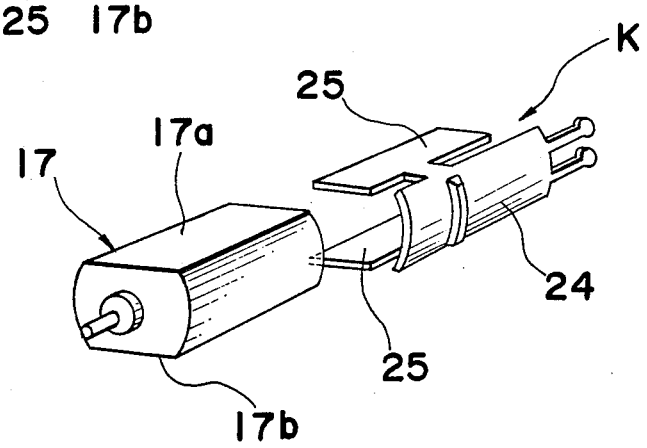
FIG. 14 is a perspective view of a switch knob and a motor employed in the electric hair clipper of FIG. 2.

In the case where the head portion 1*b* is in the fundamental position where it is held approximately on a straight line with respect to the grip portion 1*a*, the support shaft 3 has the ribs 8 of its legs 6 engaged with the recesses 11*a* of the shaft hole 12 at the side of the grip portion 1*a*, with the engaged state being maintained by the force of the spring 15 to establish a locked state as shown in FIGS. 9 and 12.

Figure 10:
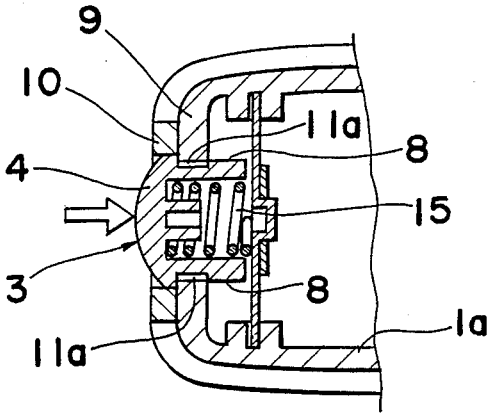
FIG. 10 is a fragmentary cross section similar to FIG. 9, which particularly shows the pivotal movement lock portion in an unlocked state, FIG. 11 cross section taken along the line XI—XI in FIG. 9.

For the change-over of the head portion 1*b* into the upwardly inclined position the ribs 8 are disengaged from the recesses 11*a* by depressing the support shaft 3 also serving as a lock member toward the interior of the casing 1 as shown in FIG. 10, and with the above state maintained as it is, the head portion 1*b* is turned upward through a predetermined angle to bring it into the upwardly inclined position. In this case, following the rotation of the head portion 1*b*, the support shaft 3 also serving as the lock member is turned in one unit with the head portion 1*b* in the same direction through an equal angle to establish a state where the ribs 8 are registered with the recesses 11*b*. Accordingly, if the support shaft 3 is released from the depressing force at this time, it is pushed back in a direction toward the outside of the casing by the force of the spring 15, with the ribs 8 brought into engagement with the recesses 11*b*, thereby to lock the head portion 1*b* in the upwardly inclined position.

For restoring the head portion 1*b* back into the fundamental position where it is held generally on a straight line with respect to the grip portion 1*a*, the ribs 8 are disengaged from the recesses 11*b* by again depressing the support shaft 3 into the casing 1, while the head portion 1*b* is turned through the same angle, but in the opposite direction to the above to register the ribs 8 with the recesses 11*a*, and thus, the locking is automatically effected upon releasing of the support shaft 3 from depression.

Driving Mechanism for Movable Blade

Figure 5:
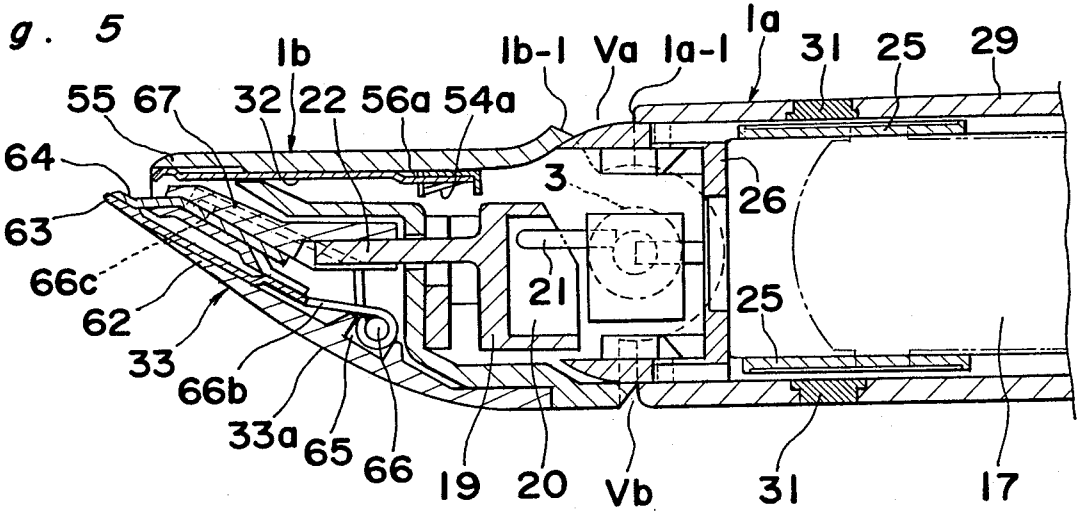
FIG. 5 is a fragmentary side sectional view of the main portion of the hair clipper of FIG. 4.
Figure 6:
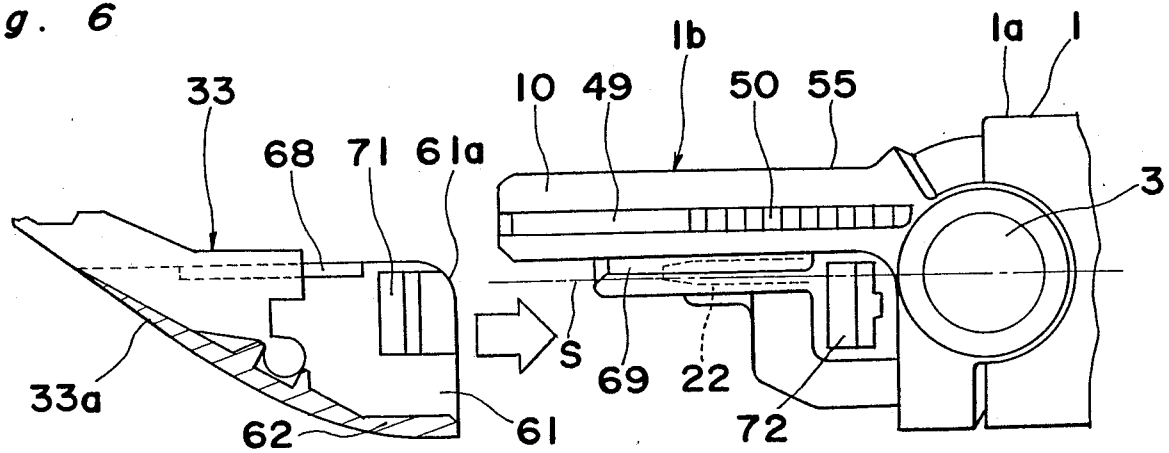
FIG. 6 is a fragmentary side elevational view of the electric hair clipper of FIG. 1, with a blade unit thereof detached.

As shown in FIGS. 4 and 5, an electric motor 17 and cells 18, etc., serving as a driving source for a movable blade driving mechanism, are incorporated within the grip portion 1*a*. The motor 17 referred to above is secured by set screws m, at its shaft projecting end face, to a motor mounting base 26 fixedly provided at a front part of the grip portion 1*a*. Inside the head portion 1*b*, there is provided a vibrating piece 19, and an eccentric pin 21 fixedly mounted on the shaft of the motor 17 is engaged with a vertically elongated concave groove 20 formed at the rear end face of the vibrating piece 19, while a vibrating lever 22 integrally formed with a forward end of the vibrating piece 19 is adapted to horizontally project toward the outside at the front part of the head portion 1*b*, and thus, when the vibrating piece 19 is subjected to lateral reciprocating vibrations by the driving of the motor 17 through the eccentric pin 21, the vibrating lever 22 integral therewith is also subjected to the reciprocating vibrations in the same direction.

Construction of Switch Knob

Referring to FIGS. 4, 5, 13 and 14, on the outer surface of the grip portion 1*a*, there is provided a slide type switch knob K for turning the motor 17 on or off. This switch knob K, which is molded by a plastic material to have a U-shaped cross section, includes a rectangular knob body 24 and sliding walls 25 integrally formed with the knob body 24 so as to extend in the same direction from upper and lower side edges of the knob body 24 in a parallel relationship to each other, with the interval between the sliding walls 25 being set to be approximately equal to a distance between upper and lower flat faces 17*a* and 17*b* of the motor 17. Thus, when the sliding walls 25 of the switch knob K are fitted over the surfaces 17*a* and 17*b* of the motor 17 for elastically holding the motor 17 between the walls 25, the switch knob K may be temporarily fixed in the state where it is positioned in the vertical and lateral directions with respect to the motor 17, and also, can be stably slid in the longitudinal direction along the upper and lower faces 17*a* and 17*b* of the motor 17 as guide portions.

On the outer surfaces of an upper wall 29 and a lower wall 30 of the grip portion 1*a*, the on and off positions of the switch knob K are displayed. More specifically, as shown in FIGS. 2 through 4, on the respective outer faces of the upper wall 29 and the lower wall 30, there are formed transparent observation windows 31, while, on the upper and lower slide walls 25 of the switch knob K, letter indications such as "OFF", "CUT", COMB-CUT Large", COMB-CUT Small", etc. are respectively printed so as to be sequentially brought into the observation windows 31 described above as the switch knob K is slidingly displaced in a stepped manner. In this case, since the slide walls 25, having the letter indications referred to above, are guided over the upper and lower faces 17*a* and 17*b* of the motor 17 as the guide portions, the sliding indications may be advantageously stabilized.

In the head portion 1*b*, a comb plate 32 is incorporated so as to be projected from or retreated into the forward end of the head portion 1*b*, while a blade unit 33 and a clipping height adjusting attachment 34 are detachably mounted on the head portion 1*b* as described in more detail later.

Clipping Height Adjusting Attachment

Figure 15:
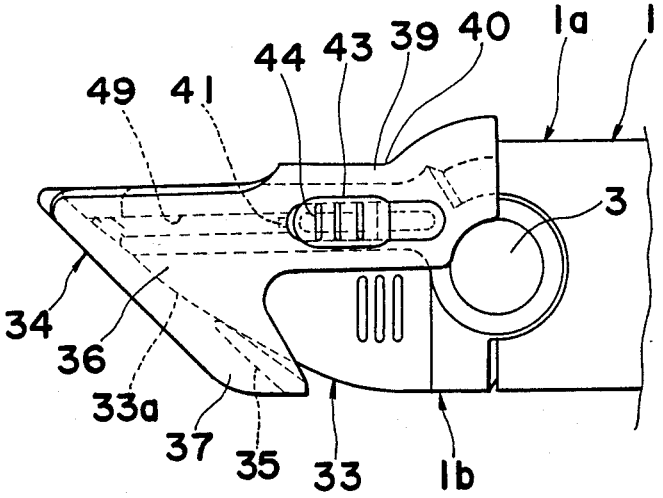
FIG. 15 is a fragmentary side elevational view of the electric hair clipper of FIG. 2, with a clipping height adjusting attachment being applied onto the head portion.
Figure 16:
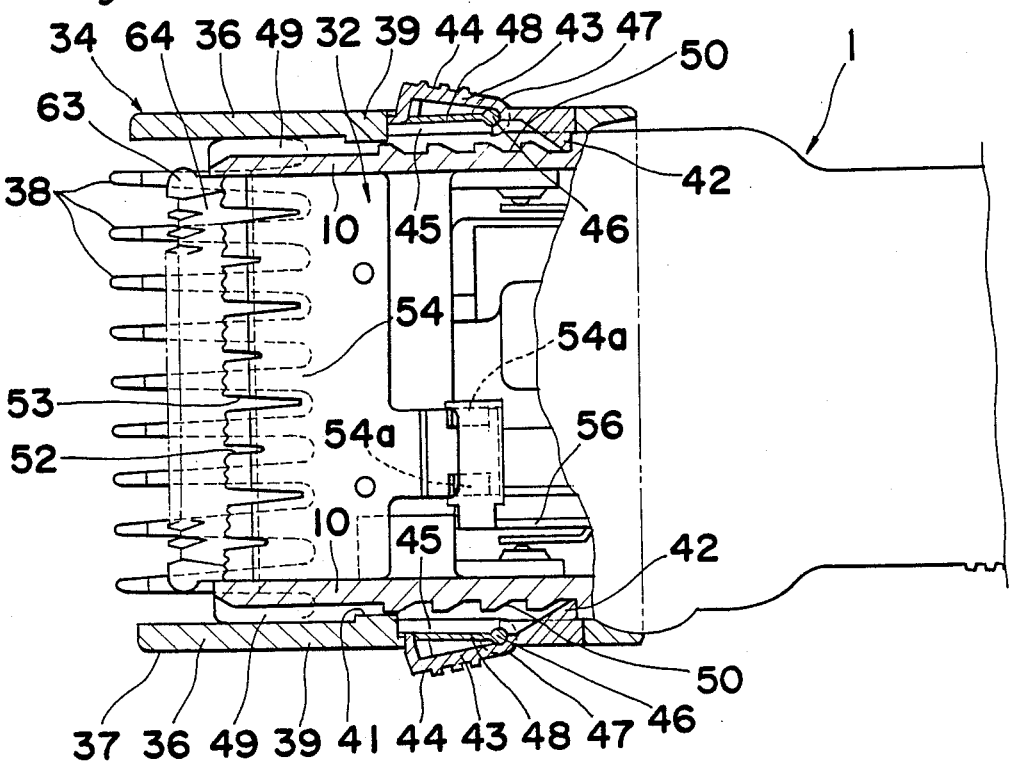
FIG. 16 is a top plan view, partly broken away, showing an internal construction of the head portion, in a state where the clipping height adjusting attachment is applied thereon.
Figure 17:
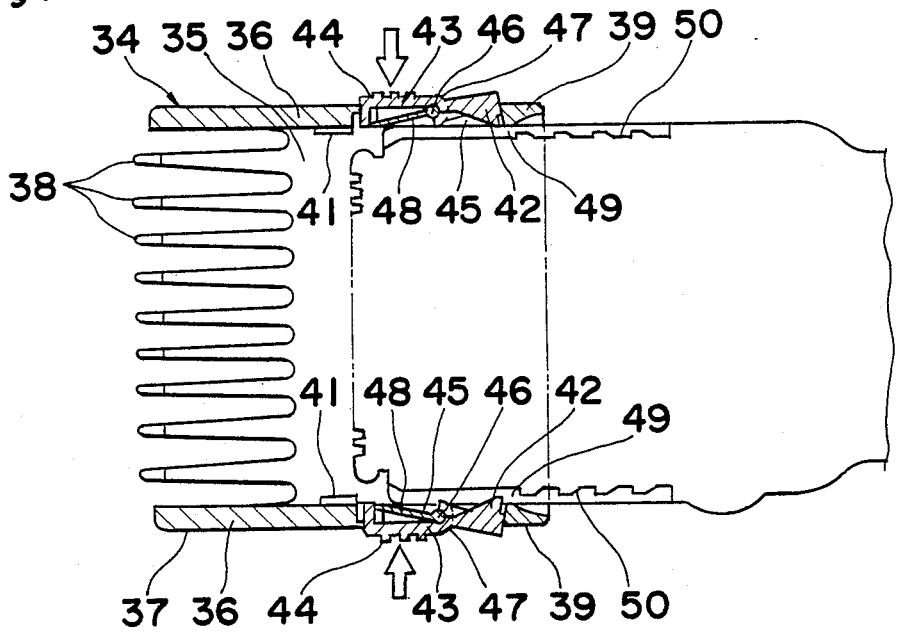
FIG. 17 is a view similar to FIG. 16, which particularly shows a process for detaching the clipping height adjusting attachment.

As shown in FIGS. 15 through 17, the clipping height adjusting attachment 34 is releasably mounted on the front part of the head portion 1*b*. This attachment 34, which is molded from a plastic material, has a comb base 35 which confronts an upwardly inclined underface 33*a* of the blade unit 33 when the attachment 34 is mounted, a comb stand 37, including side walls 36 integrally formed with opposite sides of the comb base 35 so as to extend upwardly therefrom, and a plurality of parallel and laterally aligned comb teeth 38 extending upwardly in a forward direction from the front edge of the comb base 35. Moreover, slide engaging walls 39 are integrally formed with the side walls 36 to extend rearwardly therefrom, with rear ends of the slide engaging walls 39 being integrally connected to each other through an upper wall 40. On each of the inner faces of the slide engaging walls 39, engaging projections 41 and 42 are respectively provided at front and rear positions. Each of the projections 41 at the front side also serves as a sliding guide, while the rear side engaging projection 42 is integrally formed on a rear end inner face of a slide lock piece 43 separately formed from the slide engaging wall 39, and a finger catch 44 is provided at the forward end outer face of the slide lock piece 43. Each of the above slide lock pieces 43 is fitted into a through-hole 45 formed at part of the slide engaging wall 39, while a bearing portion 47 provided at an intermediate portion in the longitudinal direction of the slide lock piece 43 is pivotally engaged with a vertical shaft 46 integrally formed with the wall 39 within the through-hole 45 in a vertical direction. The vertical shaft 46 has a resilient lug 48 integrally formed therewith in a cantilever fashion, and by the resiliency of the resilient lug 48, the slide lock piece 43 is urged so that the engaging projection 42 is normally directed into the attachment, thereby causing the finger catch 44 to project toward the outside of the attachment.

Accordingly, the clipping height adjusting attachment 34 as described above is mounted so that the engaging projections 41 and 42 at the left and right sides are slidably fitted, from the forward portion of the head portion 1*b*, into guide grooves 49 axially formed in side walls 10 of the head portion 1*b* so as to be releasably engaged with sawtooth-like engaging portions 50 provided in a stepped manner within the guide grooves 49. By the successive sliding engagement of such clipping height adjusting attachment 34 with the head portion 1*b*, the distance between the comb teeth 38 and the stationary blade 63, to be described later, may be varied stepwise to obtain the desired clipping height. In the above case, since the engaging projection 42 is provided at the rear side with respect to the vertical shaft 46 for the slide lock piece 43, with the projection being urged for entry by the resilient lug 48, when the comb teeth 38 are applied onto skin during use, the engaging projections 42 are adapted to strongly cut in between the engaging portions 50 by skin pressure so as to retain the attachment 34 more positively.

Advancing and Retreating Construction for Comb Plate

Figure 18:
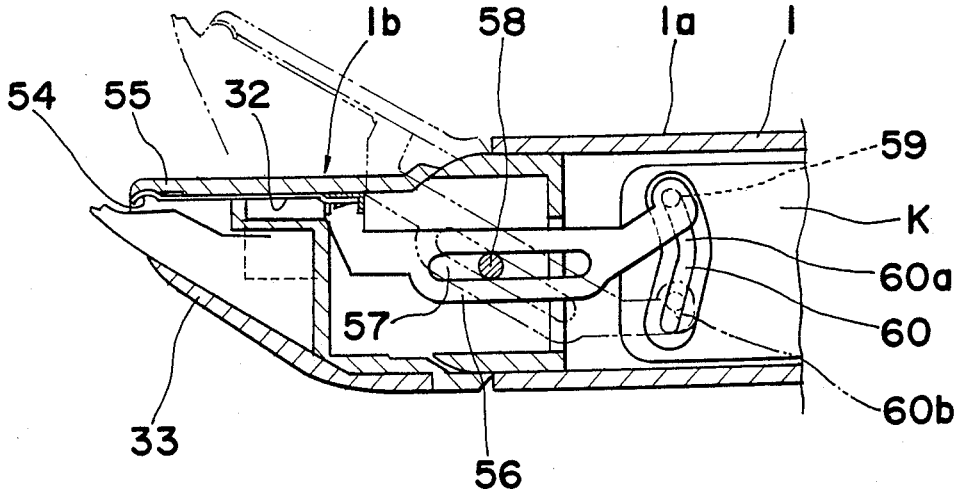
FIG. 18 is a side sectional view of the electrical hair clipper similar to FIG. 5, which particularly shows an advancing and retreating mechanism of a comb plate provided in the main body casing.
Figure 19:
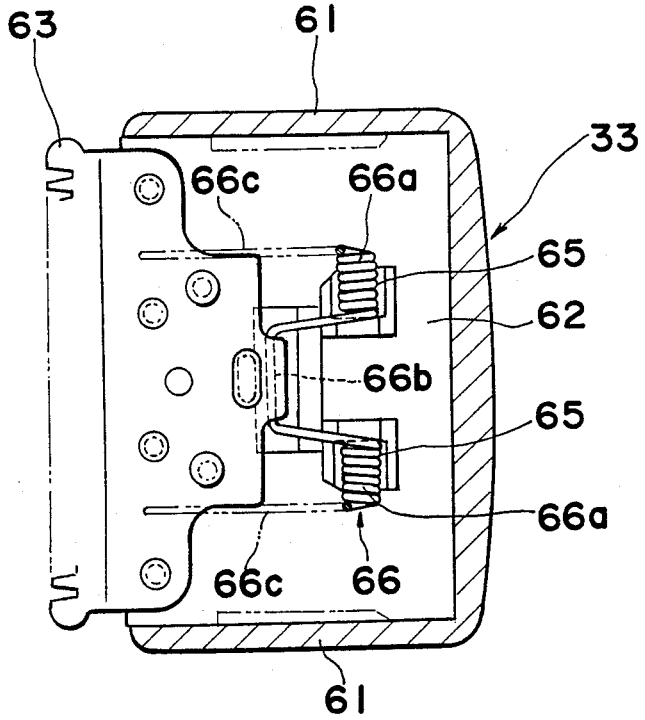
FIG. 19 is a fragmentary top plan view, partly in sections, showing a construction of the blade unit.

With particular reference to FIGS. 16 and 18, the comb plate 32 has combing teeth 54 at its forward edge in which shallow grooves 52 and deep grooves 53 are alternately formed side by side in a lateral direction (FIG. 16), and the above combing teeth 54 are adapted to be advanced from or retreated into a gap between an upper wall 55 of the head portion 1*b* and the blade edge of the blade unit 33.

As shown in FIG. 18, the mechanism for advancing and retreating the comb plate 32 includes a combing cut lever 56 connected to a rear end of the comb plate 32, and a pin 58 provided at the side of the grip portion 1*a* in a position on the same axis as the support shafts 3 and slidably fitted into an elongated slot 57 longitudinally formed at an intermediate portion of the lever 56, with a guide pin 59 provided at the rear end of the lever 56 being slidably engaged with a V-shaped guide groove 60 formed in the inner face side of the switch knob K described earlier. Thus, since the guide pin 59 slidingly moves within the guide groove 60 when the head portion 1*b* is pivoted about the support shafts 3, the comb plate 32 is turned about the pin 58 in one unit with the head portion 1*b* in the same direction.

When the head portion 1*b* is in the fundamental position where it is held on a straight line with respect to the grip portion 1*a*, the guide pin 59 of the lever 56 for the comb plate 32 is located at the upper end of an arcuate upper half portion 60*a* of the guide groove 60, and upon sliding of the switch knob K in FIG. 4 from the position for the indication "CUT" to the forward position for "COMB-CUT Large", the comb teeth 54 slightly project forward from the upper wall 55 of the head portion 1*b*. Since both of the shallow grooves 52 and deep grooves 53 overlap the blade edge of the blade unit 33, hair introduced into both of the grooves 52 and 53 is subjected to the comb-cutting. When the switch knob K is further slid forward up to the position for the indication "COMB-CUT Small", the shallow grooves 52 of the comb teeth 54 are caused to project beyond the blade edge of the blade unit 33, so that only the deep grooves 53 overlap the blade edge of the blade unit 33, and in the above projected state, only the hair introduced into the deep grooves 53 is subjected to the comb-cutting.

Meanwhile, when the head portion 1*b* is in the upwardly inclined position, the comb plate 32 has the guide pin 59 located in the straight lower half portion 60*b* of the guide groove 60, and when the switch knob K is slid from the position for the indication "CUT" to the position for the indication "COMB-CUT Large", the state for comb-cutting the hair introduced into both the shallow grooves 52 and the deep grooves 53 may be obtained as described earlier, and upon further sliding of the switch knob K up to the position for the indication "COMB-CUT Small", the state for comb-cutting only the hair introduced into the deep grooves 53 can be achieved.

With respect to the connection between the rear edge of the comb plate 32, i.e., the comb teeth 54 and the front end of the lever 56, as shown in FIGS. 5 and 16, deformable resilient retaining claws 54*a* are provided at the rear edge of the comb teeth 54, and the rear edge having the claws 54*a* is inserted into a narrow lateral groove 56*a* open at the front edge of the lever 56, whereby the rear edge of the comb teeth 54 is coupled to the front edge of the lever 56 so as to be retained through utilization of the elastic deformation of the retaining claws 54*a*.

Construction of Blade Unit 33

In FIGS. 5 through 7 and 16, the blade unit 33 includes a blade unit base 62 with lateral side walls 61 having a U-shaped cross section, the comb-like stationary blade 63 secured to the inner face of the unit base 62, with the blade edge thereof projecting forward, and the similar comb-like movable blade 64 urged to be pressed against the upper face of the stationary blade 63 by a spring member 66 fixed on the unit base 62. For the spring member 66, a torsion coil spring is employed, and includes a pair of coil spring portions 66*a* disposed in corresponding recesses 65 formed in the inner face of the unit base 62, an intermediate end portion 66*b* formed between the coil spring portions 66*a* and engaged with the under face side at the rear end of the stationary blade 63, and free ends 66*c* at the opposite sides resiliently engaging the upper face of the movable blade 64. If the intermediate end portion 66*b* is preliminarily held between the stationary blade 63 and the blade unit base 62 when the stationary blade 63 is staked by heating the blade unit base 62, the end portion 66*b* may be secured therebetween more positively. It is needless to say that the stationary blade 63 is to be molded on the blade unit base 62, the intermediate end portion 66*b* may be inserted for engagement after the molding. As shown in FIGS. 4 and 5, on the upper face of the movable blade 64, there is fixed a follower piece 67, with which the forward end of the vibrating lever 22 is releasably engaged, and thus, the movable blade 64 is subjected to the reciprocating sliding movements over the upper surface of the stationary blade 63 in the lateral directions through the vibrating piece 19 by the rotation of the motor 17.

Construction for Mounting the Blade Unit 33

The present invention is particularly characterized by the construction for mounting the blade unit 33 arranged as described above, onto the head portion 1*b* of the main body casing 1.

As shown in FIGS. 4 through 7, with respect to the head portion 1*b*, the blade unit 33 is slidably and detachably mounted for sliding movement in the back and forth or longitudinal direction intersecting at right angles with the pivoting direction of the head portion 1*b*, through an engaging and sliding means including sliding projections 68 provided in the blade unit 33 and corresponding guide grooves 69 formed in the head portion 1*b*, with the engaging and sliding means being positionally set approximately on the same line as a longitudinal line or back and forth line S passing through a center of the support shafts 3.

Figure 7:
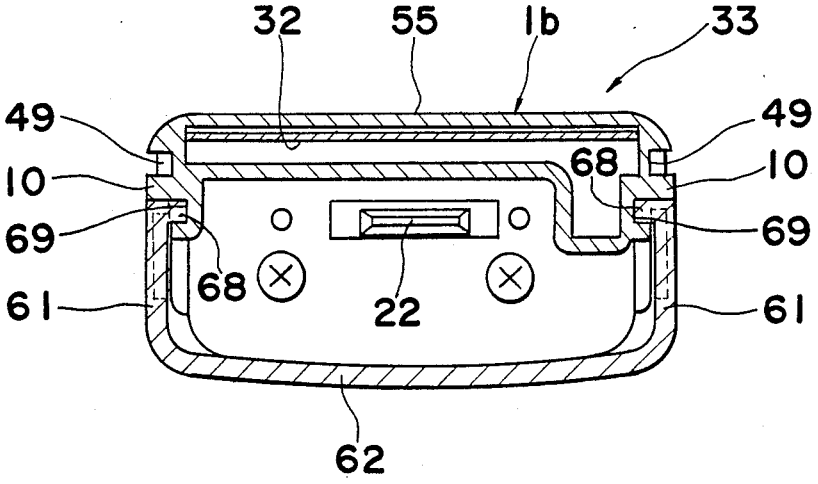
FIG. 7 is a cross section of a head portion of the electric hair clipper of FIG. 5, with the blade unit thereof removed.

More specifically, as illustrated in FIGS. 4, 5 and 7, the sliding projections 68 are longitudinally formed on the upper inner faces of the opposite side walls 61 of the blade unit 33, while the guide grooves 69, in which the sliding projections 68 are slidably fitted in the longitudinal direction, are formed in the outer faces of the opposite side walls 10 of the head portion 1*b* approximately on the same line as a line passing through the center of the support shafts 3. In the embodiment as illustrated, the guide grooves 69 are positioned on the longitudinal line slightly deviated upward (by about 1 or 2 mm) from the longitudinal line S passing through the center of the support shafts 3. By way of example, the guide grooves 69 are formed at the underside of the guide grooves 49 for the clipping height adjusting attachment 34 in a parallel relationship therewith. Moreover, between the blade unit 33 and the head portion 1*b*, there is provided a locking means for holding the blade unit 33 in the mounted position. The above locking means includes engaging recesses 71 formed in the rear end inner faces of the opposite side walls 61 of the blade unit base 62 in positions after the sliding projections 68, and corresponding engaging pieces 72 movably provided through plate springs 73 for projection and retreatment in positions after the guide grooves 69 of the opposite side walls 10 of the head portion 1*b*, whereby, following the attachment or detachment of the blade unit 33, the engaging pieces 72 are engaged with or disengaged from the engaging recesses 71.

Accordingly, by holding the blade unit 33 at its opposite side walls 61, when the blade unit 33 is forced into the head portion 1*b* rearwardly, with the sliding projections 68 inserted into the guide grooves 69 of the head portion 1*b* from the front side, the engaging pieces 72 are once retreated against the springs 73 by the depressing force of tapered rear edges 61*a* of the opposite side walls 61 of the blade unit 33, and then, project to engage the engaging recesses 71, while the follower piece 67 is fitted onto the forward end of the vibrating lever 22, and thus, the blade unit 33 is held ready for use, with the blade edge thereof projecting before the head portion 1*b*. It is to be noted here that the direction for insertion or withdrawal of the forward end of the vibrating lever 22 with respect to the follower piece 67 is arranged to be parallel with the direction for attaching or detaching the blade unit 33.

In the above case, since the sliding projections 68 and the guide grooves 69 are positioned approximately on the same line as the longitudinal line passing through the center of the support shafts 3, the head portion 1*b* is free from application thereto of any unnecessary turning moment during mounting of the blade unit 33, without any possibility that the head portion 1*b* is undesirably pivoted from the fundamental position to the upwardly inclined position or vice versa. Moreover, when the locking means is provided as described above, no damage, such as breaking of the ribs 8 of the lock means, etc. is caused during mounting of the blade unit 33, although the present invention has no intention of limiting the above pivoting lock means.

For the detachment of the blade unit 33, when the blade unit 33 is withdrawn forwardly through guiding by the guide grooves 69, with the opposite side walls 61 of the blade unit 33 held by hand, the engaging pieces 72 are retreated against the springs 73 by the depressing force of the rear wall faces within the engaging recesses 71 formed in the opposite side walls 61 so as to be released from the engagement for locking, while the follower piece 67 is drawn out from the forward end of the vibrating lever 22, and thus, the blade unit 33 is removed forwardly from the head portion 1*b*.

It should be noted here that the present invention is not limited in its application to the foregoing embodiment alone, but may be varied or modified in various ways within the scope. For example, the positional relationship between the sliding projections 68 and the guide grooves 69 may be reversed as compared with that in the foregoing embodiment. More specifically, the sliding projections 68 may be provided at the side of the head portion 1*b*, while the guide grooves 69 are formed at the side of the blade unit 33. Moreover, the positional relationship between the engaging recesses 71 and the engaging pieces 72 may also be reversed as compared with that in the foregoing embodiment, and the springs 73 for urging the engaging pieces 72 may be modified to be provided only at either one side of the engaging pieces 72 at the opposite sides.

It is needless to say that the present invention may be applied to a hair clipper of an exclusively rechargeable cell type or of an exclusively AC power supply type, beside the electric hair clipper of the type adopting both rechargeable cells and an AC power supply.

As is clear from the foregoing description, according to the present invention, since it is so arranged that the blade unit 33 is detachably mounted on the head portion 1*b* of the main body casing 1 through sliding engagement thereof in the longitudinal or back and forth direction intersecting at right angles with the pivoting direction of the head portion 1*b*, the attachment or detachment of the blade unit 33 may be safely effected through simple operation without applying excessive loads or torsion to the pivotal shafts or pivotal angle restricting portion of the head portion 1*b*. Moreover, during detachment of the blade unit 33, the blade unit 33 may be conveniently taken out by holding the outer faces of the opposite side walls 61 thereof, without directly applying finger tips to the blade edge of the blade unit 33.

Especially, according to the present invention, since the engaging and sliding means for the blade unit 33 are formed approximately on the same line as the line passing through the center of the support shafts 3, unexpected pivoting of the head portion 1*b* during mounting of the blade unit 33 may be prevented for a positive and facilitated mounting operation of the blade unit 33.

Figure 20:
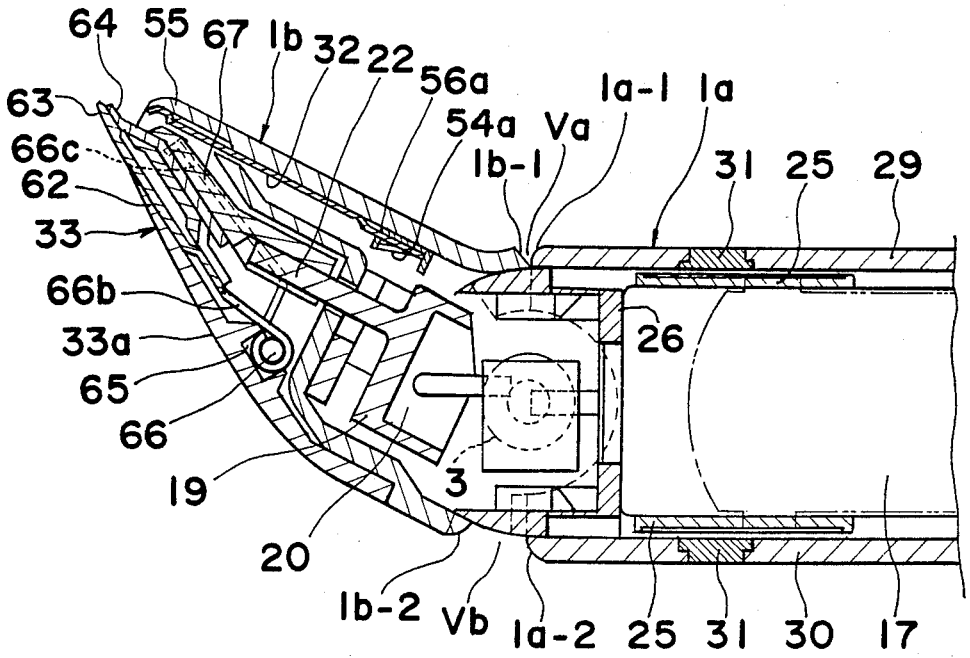
FIG. 20 is a view similar to FIG. 5, which particularly shows the head portion inclined upwardly from the state where it is held generally on a straight line with respect to the grip portion for explaining provision of a special gap between an upper rear edge of the head portion and an upper front edge of the grip portion.

Referring particularly to FIG. 5 showing the state where the head portion 1*b* is held on the straight line with respect to the grip portion 1*a*, and also to FIG. 20 showing the state where the head portion 1*b* is pivoted about the support shafts 3 so as to be inclined upwardly, at least on the upper surface of the main body casing, there is formed a gap Va between a forward edge 1*a*-1 of the grip portion 1*a* and a rear edge 1*b*-1 of the head portion 1*b* for permitting relative rotation between the head portion 1*b* and the grip portion 1*a*, and the gap Va is set to be rather large to such an extent that part of the gap Va still remains even when the head portion 1*b* has been inclined upwardly as in FIG. 20.

For example, if the gap as described above should be set in dimensions such that, upon turning of the head portion 1*b* into the upwardly inclined position, the rear edge 1*b*-1 of the head portion 1*b* fully contacts the corresponding forward edge 1*a*-1 of the grip portion 1*a* for disappearance of the gap therebetween, there may arise problems that, when the hair clipper is used in the fundamental position at which the head portion 1*b* is held approximately on the straight line with respect to the grip portion 1*a*, cut hair enters the above gap, and is strongly held between the rear edge 1*b*-1 of the head portion 1*b* and the forward edge 1*a* of the grip portion 1*a* when the head portion 1*b* is to be turned into the upwardly inclined position, thus resulting in such inconveniences that complete rotation of the head portion 1*b* up to the predetermined upwardly inclined angular position is obstructed by cut hair or upon rotation of the head portion 1*b* back into the original fundamental position for storing after use, the cut hair thus held falls to the ground. Therefore, according to the present invention, the gap Va is preliminarily set to be rather large so that some gap is present at all times both in cases where the head portion 1*b* is in the fundamental position and in the upwardly inclined position, thereby to eliminate the problems related to the cut hair held in the gap.

Figure 21:
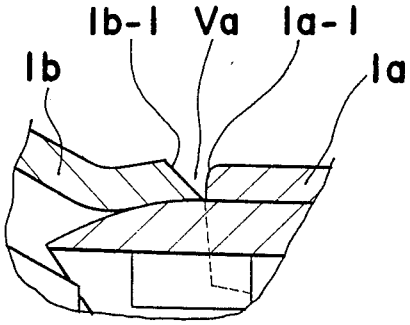
FIG. 21 is a fragmentary cross section showing on an enlarged scale, the gap portion in FIG. 20.

More specifically, as shown on an enlarged scale in FIG. 21, at the upper surface 29 of the main body casing 1, the gap Va is set to be rather large in its width in the longitudinal direction so that the gap Va still remains in a divergent V-shaped cross section between the rear and forward edges 1*b*-1 and 1*a*-1 even when the head portion 1*b* is held in the upwardly inclined position. Accordingly, in the case where the hair clipper is used, when the head portion 1*b* held in the fundamental position generally on the straight line with respect to the grip portion 1*a*, although cut hair may enter the gap Va, the gap Va is not completely eliminated, but merely reduced in width in the longitudinal direction even when the head portion 1*b* is rotated into the upwardly inclined position, with the cut hair present in the gap, and therefore, the cut hair in the gap Va is directed toward the open portion of the gap Va, without being held between the rear edge 1*b*-1 of the head portion 1*b* and the forward edge 1*a*-1 of the grip portion 1*a*. Moreover, the cut hair in the remaining gap Va may be readily brushed off, with the head portion 1*b* held in the upwardly inclined position. Furthermore, also with respect to another gap Vb to be formed between the rear edge 1*b*-2 of the head portion 1*b* and the forward edge 1*a*-2 of the grip portion 1*a* at the under surface 30 of the main body casing 1 when the head portion 1*b* is in the upwardly directed position, the gap Vb may be so arranged as to remain by a predetermined width, without being completely eliminated, even if the head portion 1*b* is brought into the fundamental position held on the straight line with respect to the grip portion 1*a*, whereby during the comb-cutting in which the upper and under surfaces 29 and 30 of the main body casing 1 are reversed after the head portion 1*b* has been turned into the upwardly inclined position, even if cut hair has entered the under side gap Vb directed upwardly, holding of the cut hair between the edges 1*b*-2 and 1*a*-2 may be similarly prevented as in the case of the upper gap Va described earlier.

Figure 22:
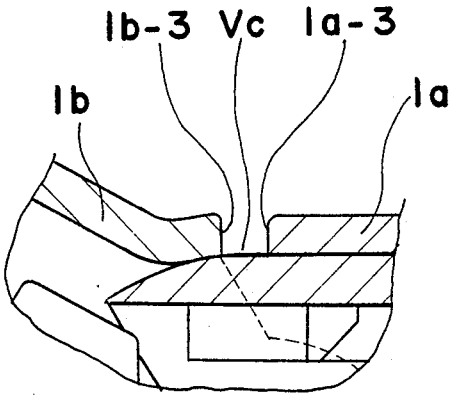
FIG. 22 is a cross section similar to FIG. 21, which particularly shows a modification thereof.
Figure 23:
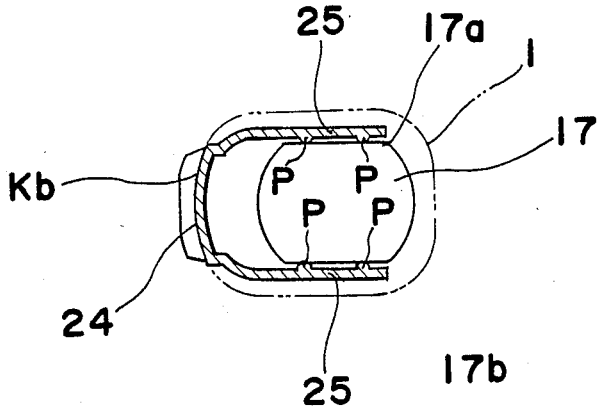
FIGS. 23 through 27 are cross sections similar to FIG. 13, which particularly show modifications thereof.
Figure 24:
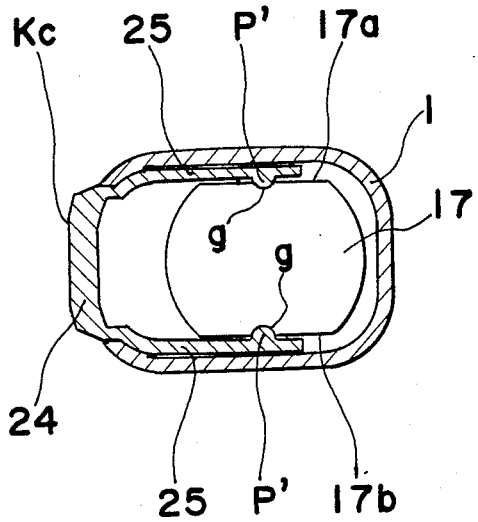
Figure 25:
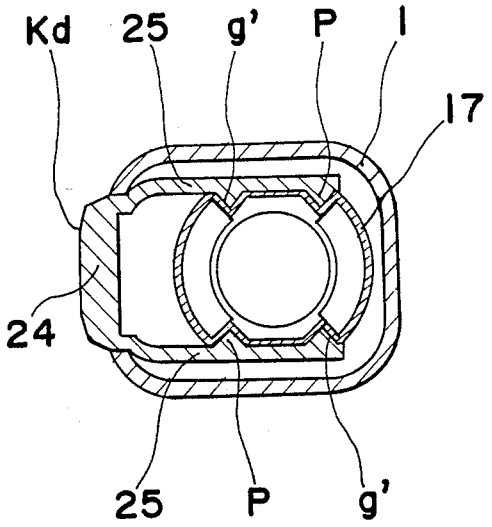

It should be noted here that the remaining gap Va described as formed into the V-shaped cross section in the foregoing embodiment may be replaced by a modified remaining gap Vc of a rectangular shape defined between the rear edge 1*b*-3 of the head portion 1*b* and the forward edge 1*a*-3 of the grip portion 1*a* which are directed generally a parallel relationship to each other as shown in FIG. 22.

Referring further to FIGS. 23 through 27, there are shown modifications of the construction of the switch knob K described earlier with reference to FIGS. 4, 5, 13 and 14. In the modified switch knob Kb in FIG. 23, protrusions p in the form of lines or dots are formed on inner surfaces of the respective slide walls 25 extending from the side edges of the knob body 24 for contact with the corresponding outer surfaces 17*a* and 17*b* of the motor 17 so as to smoother sliding operation through reduction of frictional resistance with respect to surfaces 17*a* and 17*b*. In another modified switch knob Kc in FIG. 24, concave grooves g are formed in the outer surfaces 17*a* and 17*b* of the motor 17 in the longitudinal direction, while corresponding protrusions p' provided on the inner surfaces of the respective slide walls 25 are slidably fitted into groove g for guiding the switch knob Kc straight in the longitudinal direction by the engagement therebetween, without any possibility of disengagement of the switch knob Kc from the motor 17 in the lateral direction. For providing the concave groove g in the outer surfaces 17*a* and 17*b* of the motor 17, the grooves g' of the motor 17 for securing a magnet thereof may be utilized for the purpose as illustrated in the switch knob Kd of FIG. 25.

Figure 26:
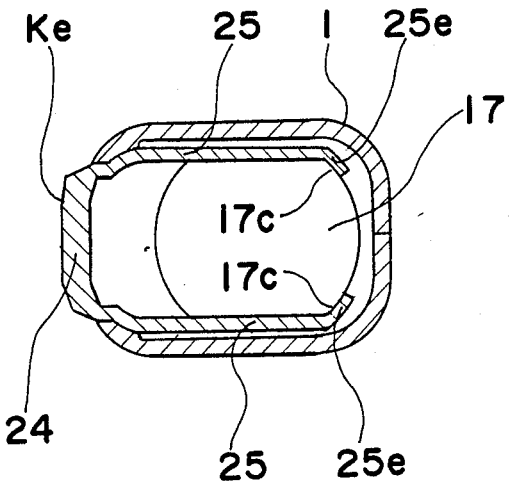

Moreover, as shown in the modified switch knob Ke of FIG. 26, engaging portions 25*e* are respectively formed at free end side edges of the sliding walls 25 for engagement with the corresponding side faces 17*c* of the motor 17, whereby the positive sliding movement of the switch knob in the longitudinal direction may also be achieved, while the disengagement of the switch knob in the lateral direction with respect to the motor 17 can be advantageously prevented.

Figure 27:
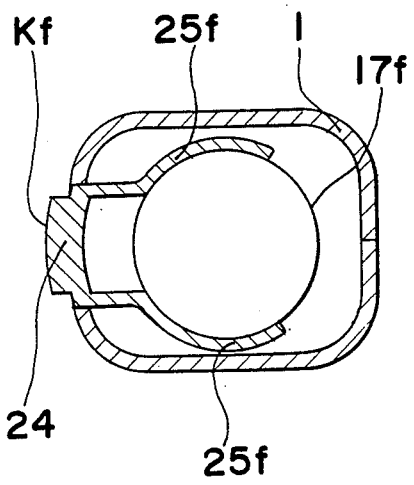

Furthermore, when the motor has a circular cross section as in the motor 17*f* in FIG. 27, the sliding walls 25*f* of the switch knob Kf are formed to have an arcuate cross section, and slidably fitted onto the outer peripheral surface of the motor 17*f*, and thus, similar effects as in the foregoing switch knobs may be achieved.

Figure 28:
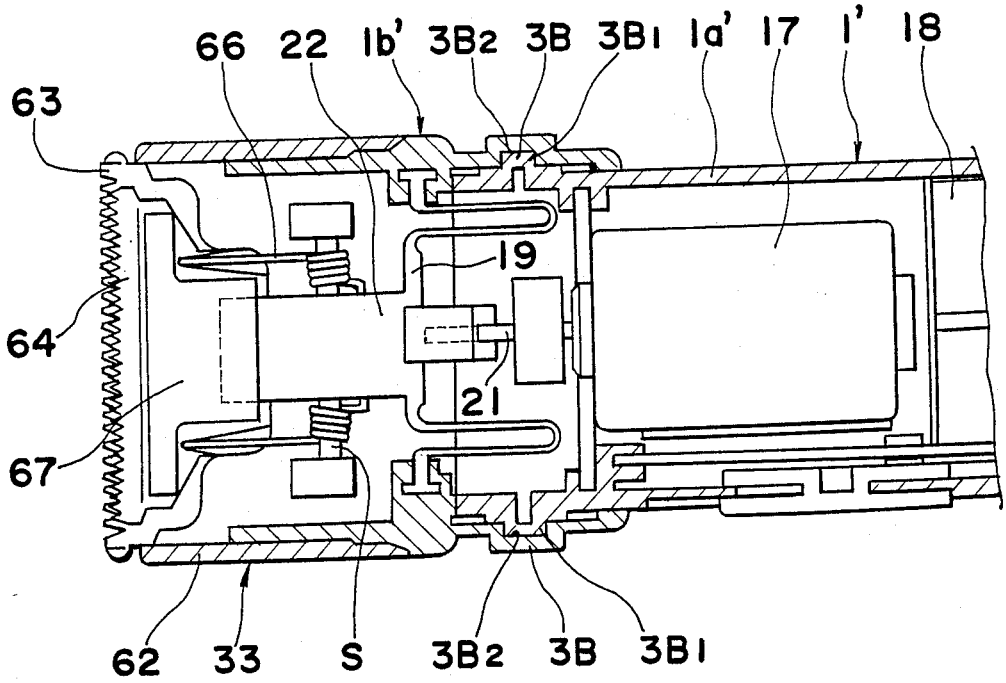
FIG. 28 is a fragmentary top plan sectional view similar to FIG. 4, which particularly shows a modification thereof.
Figure 29:
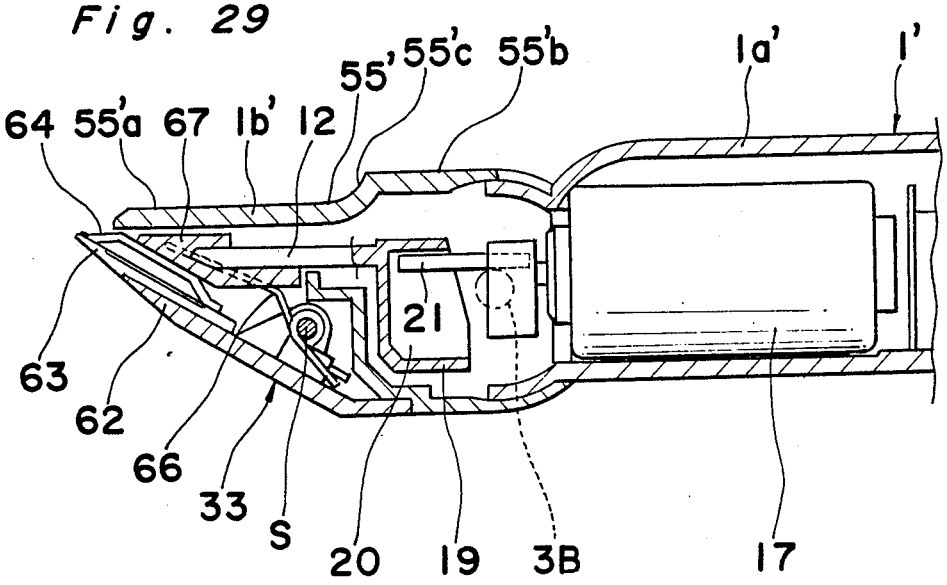
FIG. 29 is a side sectional view of the modified hair clipper in FIG. 28.
Figure 30:
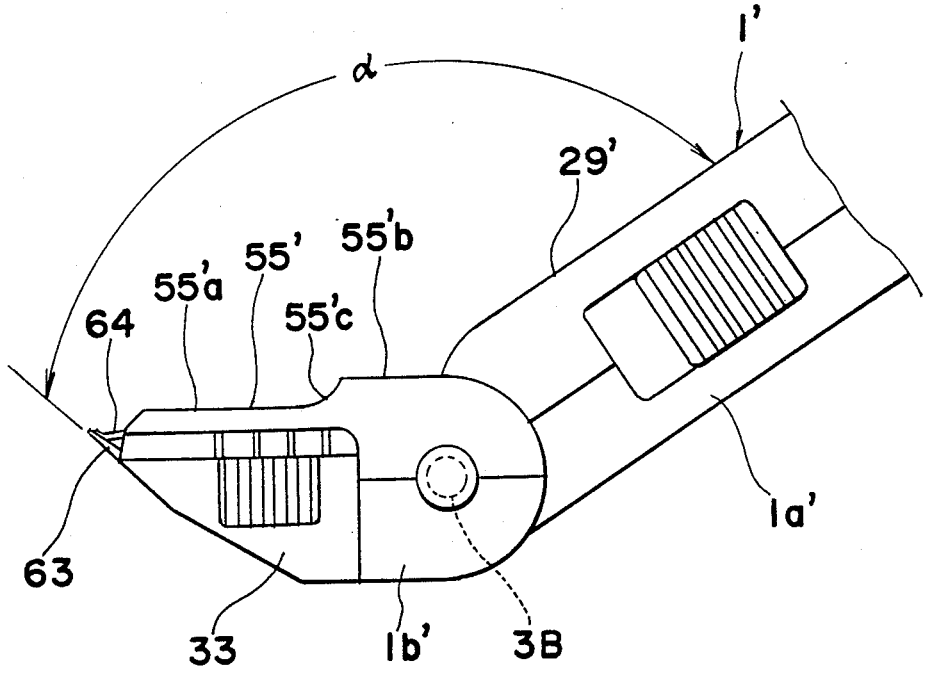
FIG. 30 is a schematic side elevational view of the hair clipper of FIG. 28, with the head portion thereof inclined at a predetermined angle with respect to the grip portion.

Referring further to FIGS. 28 through 30, there is shown a further modification of the hair clipper as described earlier with reference to FIGS. 2 to 19.

The modified hair clipper of FIGS. 28 to 30 also has its head portion 1*b*' arranged to be pivotable between one position where it is held generally on a straight line with respect to the grip portion 1*a*' and the other position where it is inclined upwardly with respect to the grip portion 1*a*, but is simplified in the structure, with the comb plate 32 and the mechanism associated therewith, and the head portion pivotal movement lock means, etc. described as employed in the arrangement of FIGS. 2 through 19 being omitted.

More specifically, the grip portion 1*a*' of the main body casing 1' has projections or pins 3B1 projecting outwardly from the opposite sides at the forward end portion thereof, while the head portion 1*b*' is formed with corresponding recesses 3B2 which are slidably fitted over the projections 3B1, and thus, the support shafts 3B are provided to permit the pivotal movement of the head portion 1*b*'.

The upper surface 55' of the head portion 1*b*' has its rear portion 55'*b* formed to be raised higher than the front portion 55'*a* thereof to provide a cut hair receiving stepped portion 55'*c* therebetween, thereby to prevent the cut hair accumulated on the front portion 55'*a* from moving toward the rear portion 55'*b*. For cutting at the border of the back hair, the head portion 1*b* is turned into the upwardly directed position, at which an angle $\alpha$ of the stationary blade 63 with respect to the upper surface 29' of the grip portion 1*a*' becomes smaller than in the case where the head portion 1*b*' is in the fundamental position and held approximately on the straight line with respect to the grip portion 1*a*, and thus, the border of the back hair may be readily cut by turning the head portion 1*b* into the upwardly directed position, while entry of cut hair into the main body casing 1' can be prevented, with adhesion of cut hair onto the grip portion 1*a*' being also prevented.

Since other constructions and effects of the hair clipper of FIGS. 28 to 30 are generally similar to those in the arrangement of FIGS. 2 to 19, detailed description thereof is abbreviated here for brevity, with like parts being designated by like reference numerals.

Although the present invention has been fully described by way of example with reference to the accompanying drawings, it is to be noted here that various changes and modifications will be apparent to those skilled in the art. Therefore, unless otherwise such changes and modifications depart from the spirit and scope of the present invention, they should be construed as included therein.

What is claimed is:

1. An electric hair clipper which comprises a main body casing having a grip portion provided therein with a motor and a power switch and a head portion pivotally connected to said grip portion at a support axis for pivotal movement about said support axis with respect to said grip portion, and a blade unit including a stationary blade, a movable blade adapted to slidably contact the stationary blade under pressure and a follower piece fixed to said movable blade, said blade unit being slidably and detachably mounted on said head a portion in position beyond said support axis through an engaging and sliding means, said head portion being provided with a vibrating piece for converting rotation of the motor into reciprocating movement, with a vibrating lever formed at one end of said vibrating piece being arranged to project toward a blade unit mounting portion at a forward side of the head portion for engagement with said follower piece upon mounting of the blade unit onto said head portion, said vibrating piece being adapted to effect the pivotal movement together with said head portion, with a shaft of the motor being associated with said follower piece by said vibrating piece, said head portion being arranged to pivotally move between a first position where its axis is held generally on a straight line with respect to an axis of said grip portion and a second position where its axis is inclined to form a predetermined angle with respect to the axis of said grip portion, with only the blade edge being exposed out of said head portion so as to be located above an extension line of the upper wall of the grip portion.

2. An electric hair clipper as claimed in claim 1, wherein said blade unit is arranged to be detachably mounted through the engaging and sliding means onto the head portion from a forward side of said head portion through sliding movement thereof in a longitudinal direction intersecting at right angles with upward and downward directions for the pivotal movement of said head portion.

3. An electric hair clipper as claimed in claim 2, wherein said engaging and sliding means includes sliding projections and corresponding guide grooves in which said sliding projections are fitted for a sliding movement therein, said sliding projections and guide grooves being respectively provided in said blade unit and head portion, said engaging and sliding means being positionally set approximately on the same line as a line in the longitudinal direction passing through a center of said support axis.

4. An electric hair clipper as claimed in claim 2, wherein the direction of mounting of said blade unit onto the head portion is generally on the same line as the line passing through the center of said support axis.

5. An electric hair clipper as claimed in claim 1, wherein said support axis for the pivotal movement of said head portion includes support shafts provided with a pivotal movement lock means for locking said head portion at said first or second position or releasing said head portion from the lock at said position.

6. An electric hair clipper as claimed in claim 1, wherein a gap for allowing cut hair to escape is provided between said head portion and said grip portion, said gap being adapted to be rather large in size in said first position of said head portion to such an extent that part of said gap still remains in said second position of said head portion so as not to strongly hold cut hair between said head portion and said grip portion.

7. An electric hair clipper as claimed in claim 1, further including a comb plate slidably provided in said head portion for advancing or retreatment with respect to the edge of said stationary blade when said blade unit is mounted on said head portion, between a position corresponding to the edge and another position not corresponding to said edge, said comb plate being arranged to be advanced or retreated with respect to the edge of the stationary blade through a space between the upper wall for said head portion and said movable blade.

8. An electric hair clipper as claimed in claim 7, wherein an operating knob for said comb plate is provided at the side of said grip portion.

9. An electric hair clipper as claimed in claim 8, wherein said operating knob for said comb plate is associated with said power switch.

10. An electric hair clipper as claimed in claim 1, wherein a direction for insertion or withdrawal of the vibrating lever with respect to said follower piece is arranged to be parallel with the direction of attaching or detaching the blade unit onto said head portion.

* * * * *